US006139438A

United States Patent [19]

Park et al.

[11] Patent Number: 6,139,438

[45] Date of Patent: Oct. 31, 2000

[54] ARTIFICIAL ICE SKATING RINK ASSEMBLY

[75] Inventors: Henry H. Park, West Los Angeled; Edward Y. Park, Fullerton; Sharon Park, Tarzana, all of Calif.

[73] Assignee: American Ice Enterprises, Corp., Los Angeles, Calif.

[21] Appl. No.: 09/414,253

[22] Filed: Oct. 7, 1999

Related U.S. Application Data

[63] Continuation-in-part of application No. 09/169,689, Oct. 9, 1998, abandoned.

[51] Int. Cl.[7] ..... A63C 19/10

[52] U.S. Cl. ..... 472/90; 472/88

[58] Field of Search ..... 472/90, 88, 89; 404/40; 428/105, 107, 109, 513, 537.1

[56] References Cited

U.S. PATENT DOCUMENTS 4,169,688 10/1979 Toshio ..... 404/40

5,837,343 11/1998 Park et al. ..... 428/109

*Primary Examiner*—Kien T. Nguyen

*Attorney, Agent, or Firm*—William J. Benman

[57] ABSTRACT

Artificial ice skating rink assemblies that can used indoors or outdoors, in all seasons, that can be readily assembled with a reduced number of assembly parts and accessories being required, and it can be used with reduced maintenance demands. In one embodiment of this invention, there is an artificial ice skating rink consisting of a plurality of panel means for providing an ice skating surface, in which each panel means has an elongate channel disposed therein having longitudinal and transverse axes. Elongate spline means are provided for slideable insertion into a channel in a lateral direction along the transverse axis of that channel, and for slideable receipt of another channel of another panel means which is forced in a lateral direction into slideable engagement with the spline. In this way, separate panel means are retained together exclusively by the spline means against relative motion along the transverse axes of their respective channels. The inventive skating rink assemblies are devoid of laminations and can contain relatively high levels of lubricant in the panel components to enhance the low-friction surface for skating. Also, as the skating rink assemblies are devoid of wood components, the assembly is well-suited for outdoor implementations where exposed to the elements throughout the year.

20 Claims, 3 Drawing Sheets

ARTIFICIAL ICE SKATING RINK ASSEMBLY

CROSS-REFERENCE TO RELATED APPLICATIONS

This application is a continuation-in-part of U.S. Pat. application Ser. No. 09/169,689, filed Oct. 9, 1998 now abandoned, which teachings are incorporated herein by reference for all purposes.

BACKGROUND OF THE INVENTION

1. Field of the Invention

The present invention relates to reduced-friction surface assemblies particularly suited for use as artificial ice skating rinks.

2. Description of the Related Art

The sport of ice skating enjoys wide popularity and is widely practiced. The practice of or exhibition of this sport on natural ice requires either the provision of an outdoor rink of suitable size or the provision of an indoor rink. The construction and maintenance of outdoor rinks are dependent on the vagaries of weather and such rinks are impractical in warm climates or during warm seasons. On the other hand, enclosed or indoor rinks using natural ice require the installation of extensive refrigeration systems to keep the ice surface at the proper temperature and prevent melting. Whether outdoor or indoor, ice skating rinks composed of natural ice also require periodic resurfacing to maintain an ice surface that is smooth and even enough to permit skating. Such resurfacing is normally accomplished by an expensive self-propelled ice surface refinishing machine, often referred to as a Zamboni machine.

To overcome these difficulties, several types of artificial skating rinks have been proposed in the past. For example, U.S. Pat. No. 3,771,891 to Nirenski et al. teaches an artificial ice skating rink formed of square panels of plastic sheet material joined together by cooperating tongues and channels integrally formed on the edges of the panels, in which the tongue-and-channel edges of the panels must be carefully machined for a precise fit so that when they are joined together, no cracks or ridges are formed at the seams where the panel edges of separate adjoining panels are brought together. U.S. Pat. No. 3,771,891 to Nirenski et al. further requires that the panels are clamped together by pairs of opposing channel members retained around the periphery of the rink assembly and drawn together by a grid of steel straps running along the underside of the rink that are clamped under tension at the channel members. From standpoints of equipment and labor requirements during installation, it would be desirable to eliminate the need for extraneous fastening and clamping means in assembling an artificial ice skating rink.

U.S. Pat. No. 4,169,688 to Toshio purports to teach an artificial ice-skating rink flooring including one embodiment in which a plurality of plastic plates are provided with edge channels and common insertion pieces of a metal or synthetic resin or the like are fitted into respective confronting panel channels, and thereafter, bores must be made extending through the plates and insertion pieces into which are inserted fixing pins and the pin heads are then cut off to be smoothly leveled with the plate surfaces. However, the necessity of such fixing pins makes the assembly or disassembly of the skating rink more complicated and labor intensive. In a second embodiment of U.S. Pat. No. 4,169,688 to Toshio, the plates must be arranged upon a cushion material layer, and the plates are then either joined using U-shaped, T-shaped, or tapered-shaped insertion pieces or, alternatively, adhesive tape must be deployed beneath the plate seams where no mechanical hook-like interlock is created between the channels and insertion piece. The need to use a cushion layer in the second embodiment of the Toshio '688 patent raises costs and increases labor, and further, the need to form complex three-dimensional shapes for the insertion pieces and complementary channel shapes in the plate edges can be expected to increase the manufacturing cost and complexity, while the alternate use adhesive tape at the plate seams raises cost and increases labor.

Moreover, the interlocking design used in one of Toshio's designs (see FIGS. (9A–B) can be expected to experience cracking, breaking and buckling at the complexly-shaped connection splines. Ice skating rink assembly materials experience expansion and contraction, and forces exterted by skaters must be absorbed by ice skating flooring. Namely, expansion and contraction mismatches between the various parts of the assembly can be expected to lead to problems, such as buckling, as well as plastic breakage and/or embrittlement problems for any small plastic pieces used on a connecting spline that will tend to absorb stresses from an adjoining larger plastic panel mass. Consequently, it can be expected that the complexly-shaped, yet small plastic pieces that are supposed to fit in an interlocking pattern in the Toshio patent increase the risk that the assembly will fail. In a third embodiment of the Toshio '688 patent, the plates again are assembled on a cushion layer with the edges of plates being fused or heat bonded together. Such a heat-bonding operation would require special equipment and it would create a permanently integrated rink structure that would be difficult to disassemble, if later necessary or desired.

A low-friction composite structural element for an artificial ice skating rink is also the subject of U.S. Pat. No. 5,387,343, which was invented by two of the current named inventors. That prior design and construction generally involved panels each formed as a laminate of thin polyolefin plastic layers (for example, 4–7 mm) adhered on both sides of a thick central wood core piece. These composite panels were assembled together with a channel-and-spline arrangement using a plastic spline inserted within a channel formed by the wood cores of adjacent panels. For the prior design, certain improvements were made to the formulations of the relatively thin plastic surface layers and adhesives used in the laminating process associated with that invention, as compared to the prior art.

However, a problem encountered with the prior wood-core based design of U.S. Pat. No. 5,387,343 is that it can not survive well in outdoor skating environments. Namely, exposure to water, high humidity, and other sources of moisture was found to cause undesirable swelling of the wood cores of the composites. Additionally, prolonged exposure to water was found to create mold, mildew and eventually wood rotting problems. This water damage to the wood core component of our prior design eventually made the panel assembly unstable and unsuitable for ice skating. Another problem associated with the prior plastic-wood composite panel structure was incompatibility caused by the mismatch in the expansion and contraction behavior of the two different laminate materials involved. The wood expanded and contracted at a slower rate than the plastic (for example, polyethylene), thus causing the thin (4–7 mm) plastic surface sheet to delaminate from the wood core, no matter what adhesive was used. As the thin plastic sheet separated, it would begin to curl, making skating dangerous if not impossible.

Therefore, a need exists for an improved artificial ice skating surface that is easier and less costly to manufacture, install and maintain which eliminates the prior art problems of buckling, delamination and/or water damage problems while still meeting performance requirements in terms of durability, stability, low wear, low water absorption, low surface friction, and high surface consistency so as to be suitable for skating.

SUMMARY OF THE INVENTION

The need in the art is addressed by the improved artificial ice skating rink assembly of the present invention. In accordance with the teachings of the present invention, thick unitary, homogenous, plastic-based panels are connected together into a rink assembly using only a plastic tongue-and-groove assembly. The inventive artificial rink assembly relies only on frictional engagement made between flat confronting surfaces of plastic spline and panel channels or grooves, which nonetheless successfully holds the panels together during installation and use. The unique all-plastic design for synthetic ice skating rinks of this invention is well-suited for outdoor applications, as it does not degrade from exposure to water. Nor does the panel assembly buckle or have surface layers that can curl, delaminate or pop off of core layers after the rink is put into service. Consequently, an ice skating rink constructed in accordance with the present teachings is more durable and stable than conventional designs and obviates many of the significant problems and design flaws associated with the prior art.

In one embodiment, the inventive artificial ice skating rink consists of a plurality of panels for providing an ice skating surface. Each panel has an elongate channel disposed therein having longitudinal and transverse axes. Elongate splines are provided for slideable insertion into a channel in a lateral direction along the transverse axis of that channel, and for slideable receipt of a channel of another panel forced in a lateral direction into slideable engagement with the spline. In this manner, separate panels are retained together exclusively by the spline against relative motion along the transverse axes of their respective channels. To achieve this, the panels and splines employed in the present invention are specially manufactured to precise dimensional tolerances.

An important feature of the inventive artificial skating rink is that the adjacent panels can be assembled together into a stable assembly for skating using only the channel-and-spline connections to attach each panel to at least one other panel without need to resort to additional adhesive bonding or mechanical attachment means, mechanisms or measures. The present invention thereby dispenses with the need to employ and handle adhesive tapes, glues, tackifiers, heat bonds, attachment pins, nails, or projections (integral or separate), straps, and so forth, to assemble and consolidate the assembly panels into a stable, unified structure that is suitable for skating in all respects. The invention also avoids the need to use complex three-dimensionally shaped interlocking means, e.g., T- or U-shapes, to connect adjoining panels, which are more vulnerable and prone to embrittlement, plastic aging effects and breakage.

Another important feature of the inventive artificial skating rink is that the assembly panels can be positioned adjacent one to another with the lower major surfaces in direct physical contact with a floor base without the need for any intervening cushion (e.g., foam) layer. This aspect of the invention also helps to reduce the number of assembly parts and accessories needed to install the skating rink. Yet another advantage of this invention is that the inventive skating rink provides a stable skating surface even though it is devoid of wood parts or components, and the absence of wood parts makes the skating rink more acceptable for outdoor uses where inadvertent exposure to water and/or humidity may be involved. Also, the skating rinks of this invention provide a skating feeling comparable to that of natural ice and without causing undue wear on skate blade edges.

Moreover, the rink assembly panel components used in the inventive artificial ice skating rink are homogenous, unitary slabs without laminations or combining with wood, and the like. Taking advantage of this, in another embodiment of the invention, the plastic panels can be loaded with a relatively large amount of lubricant during their formulation and extrusion processing because neither laminated nor wood components are not needed nor used in the assembly. The surfaces of the panels intrinsically have an improved lubricating property due to such higher lubricant levels when used. The higher loading level of lubricant endows the panels with even higher gliding factors which, in turn, reduces the need for periodic re-surfacing with extraneous sliding aids such as silicone oils. This effectively reduces the down time associated with skating rinks of the present invention.

As can be appreciated, the artificial ice skating rink assembly of the present invention represents a significant advance in the field.

DETAILED DESCRIPTION OF THE INVENTION

Figure 1A:
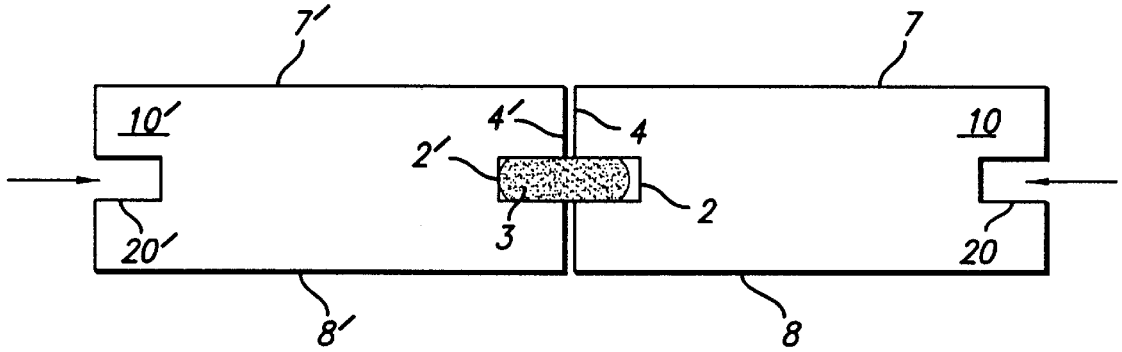
FIG. 1A is a cross-sectional view of a joint section between panels during assembly of an artificial skating rink, taken along section A-A' in FIG. 2, according to a first embodiment of this invention.
Figure 1B:
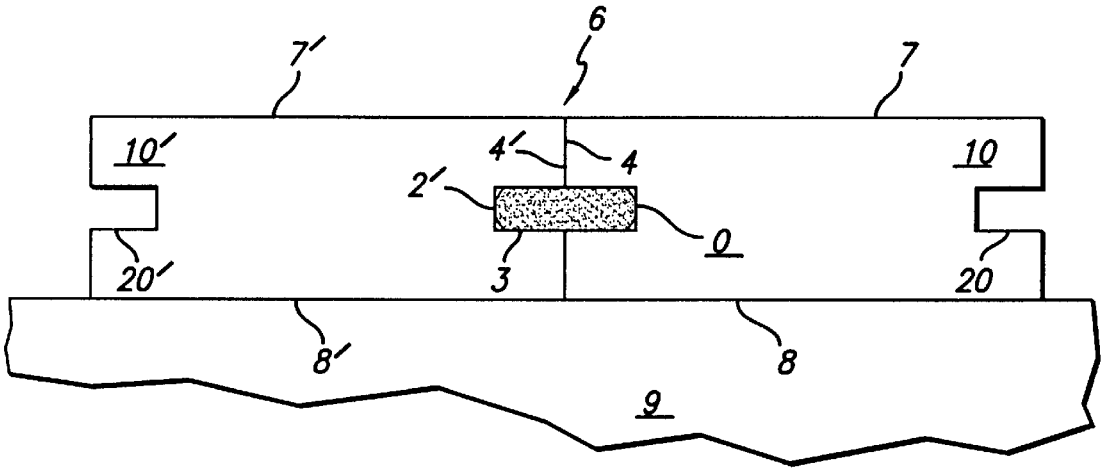
FIG. 1B is a cross-sectional view of a joint section between assembled panels of an artificial skating rink, taken along section A-A' in FIG. 2, according to the first embodiment of this invention.

Referring now to the drawings, and FIGS. 1A–B in particular, the artificial skating rink assembly of the present invention is assembled in a piecemeal, segmented manner as is initially illustrated by way of two panels. As illustrated therein, a first panel member 10 is being joined with a second panel member 10'. In a prior operation, panels 10 and 10' have respective channels or grooves 2 and 2' machined into respective side edges 4 and 4'. Spline 3 is mutually interfitted, by hand or machine, within both channels 2 and 2', in alignment, with panels 10 and 10' being laterally pushed together in the direction indicated by the arrows in FIG. 1A until the facing panel sides 4 and 4' are brought into flush contact with each other, as shown in FIG. 1B.

To ensure a tight, stable interfit, spline 3 is provided with a vertical thickness that is the same as or slightly oversized relative to the vertical thickness of channels 2 and 2', while the lateral width of spline 3 is made to be the same as or slightly oversized relative to the combined lateral width of adjacent channels 2 and 2'. Importantly, these parameters are established within extremely exact and tight tolerances described in greater detail below. Also, as depicted in FIGS. 1A and 1B, the spline 3 is generally rectangular in cross-section except for a slight rounding of the comers. Preferably, the channels 2 and 2' are centered along the sides 4 and 4' of panels 10 and 10', respectively.

Where panel sides 4 and 4' meet, a seam 6 is formed as a smooth, uninterrupted transition between the respective upper major surfaces 7 and 7' of panels 10 and 10', as assembled. The seam 6 is relatively smooth and it is not be negatively perceived or noticed by the skater, nor does it permit any water capture. Moreover, the respective coefficients of friction of the plastic materials used in the panels members 10 and 10' and spline 3 are such that the spline 3 retains panel members 10 and 10' remain in abutting face-to-face relation without the need for any physically interlocking projections on the spline or additional attachment means. No adhesive tape, glue, fusion bonding, pins, straps and so forth are used to assemble and connect panels 10 and 10' together. The lower major surfaces 8 and 8' of panels 10 and 10', respectively, are directly disposed in contact with a base support surface 9 without any intervening cushioning being necessary or used. As will be appreciated, upper major surfaces 7 and 7' of panels 10 and 10', respectively, form part of the intended skating surface.

Figure 2:
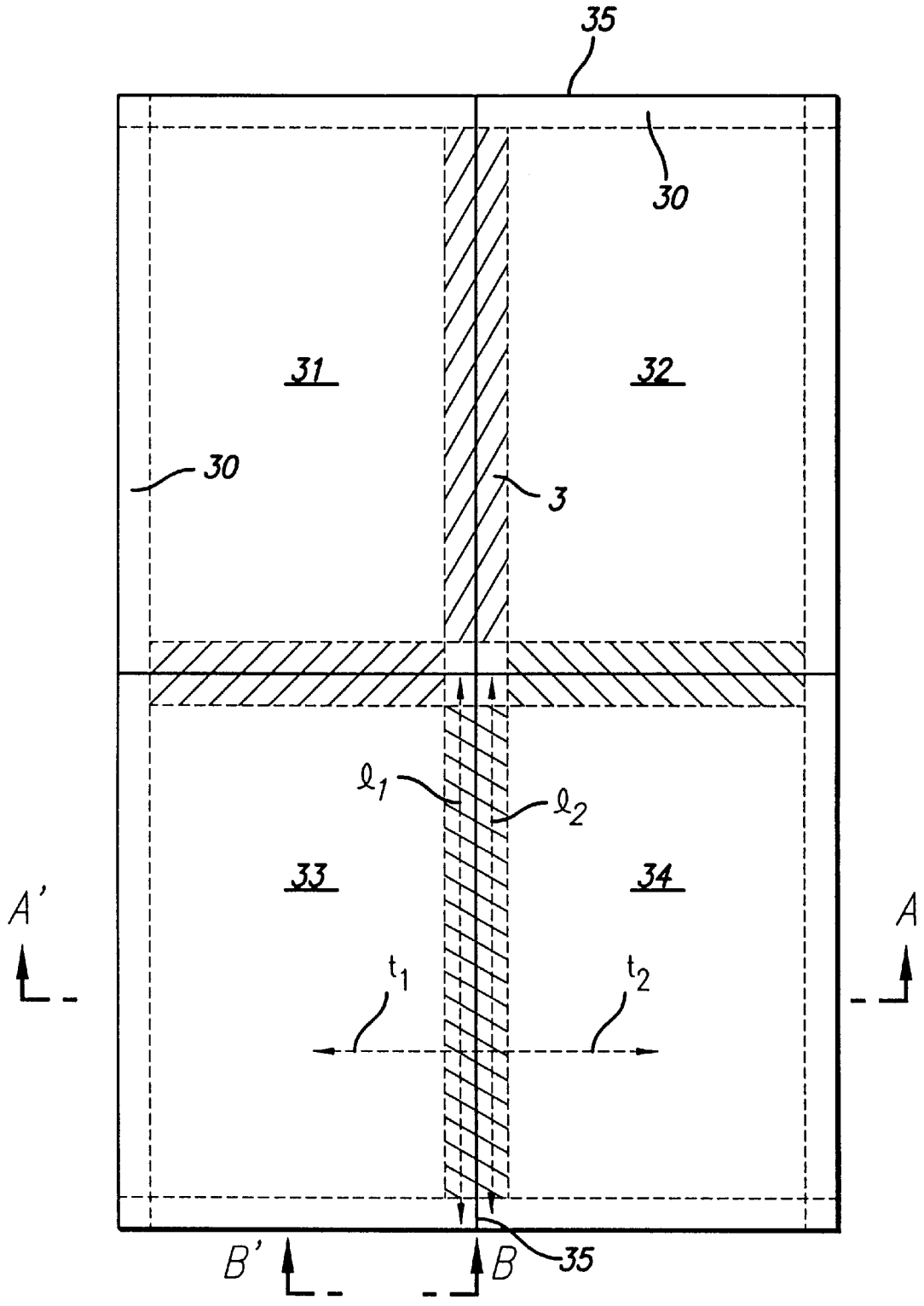
FIG. 2 is a plan view of an assembled section of panels of a skating rink according to this invention.

As illustrated in FIG. 2, which shows a larger section of the inventive skating rink, the locations of the channels 30 in the sides 35 of the panels 31, 32, 33, and 34 are indicated by dashed lines and the splines 3 as installed in the various panel channels of the assembled panels 31, 32, 33 and 34, are indicated by cross-hatched lines. The channels 30 each have a longitudinal axis and a transverse axis, such as indicated for adjoining connected panels 33 and 34 as longitudinal axes $l_1$ and $l_2$, respectively, and transverse axes $t_1$ and $t_2$, respectively. As also indicated in FIG. 2, the splines 3 do not need to extend the full side length of the panel into a channel of which it is inserted, and, preferably it stops short; e.g. a 36" by 60" (91.44 cm×152.4 cm) panel is used in combination with 34" and 58" (86.4 mm×147.3 mm) splines, respectively.

If the spline is made slightly shorter, e.g., approximately 2–7.5% shorter, than the channel length extending the length of a panel side, then the possibility is removed for a spline to jut out from a panel side for some reason during installation such as due to a slight in-plane misalignment of panel channels at a seam. On the other hand, the spline cannot be made so short relative to the side length of the panels such that an insufficient mechanical/frictional interlock is created by the channels and spline to hold the panels together. Here again, suitable parameters can be determined empirically, if necessary, for a given assembly.

The panel assembly process, as applied to panels 10 and 10' in the above manner shown in FIGS. 1A–B, and panels 31–34 in FIG. 2, typically is replicated for the other sides of the panels, such as channels 20 and 20 ' shown in FIGS. 1A, to connect them with other panels, and so on, so as to construct a rink as large as desired. Channels 20 and 20', and the like on other panel sides, are formed in the same manner as channels 2 and 2'.

The unique attributes and aspects of this invention can be further appreciated by the following descriptions of the precise structural specifications embodied by this invention. In general, major surfaces of the panels are rectangular in shape, although they also could be square or other appropriate geometric shapes that accommodate the channel and spline connection system as described herein, having dimensions of approximately 48 to 60 inches (121.9 to 152.4 cm) by approximately 36 to 48 inches (76.2 to 106.7 cm), and having a thickness defined between the upper and lower major surfaces of approximately 0.8 to 1.2 inches (2.0 to 3.0 cm). These panels have a weight of approximately 70 to 100 pounds (31.8 kg) in the case of panels made of high molecular weight polyolefin such as described herein. As will be appreciated, the splines are provided in two different lengths where the panels to be assembled have a rectangular shapes having a short and long sides, with the length dependent upon whether it is destined to be inserted in channels on a short or long side of the panels.

Figure 3:
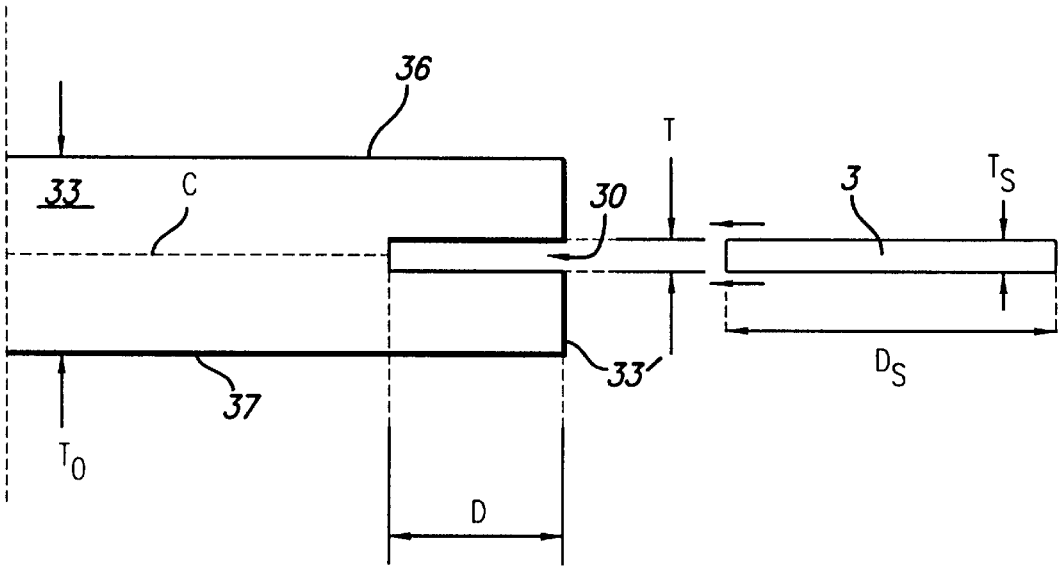
FIG. 3 is an end view of one of the assembled panels shown in FIG. 2 and according to the first embodiment of this invention taken along direction B-B' in FIG. 2.

In any event, a plastic formulation used to make panel member blanks is derived from a plastic composition, described below, that is double blended for consistency and extruded using a high capacity dual screw extruder into 1.0 one inch (2.54 cm) thick sheets. This process is relatively slow compared to customary thinner sheet extrusions, but it has been found to be necessary to produce a consistent, flat and homogenous sheet of material. In one embodiment, the plastic sheets are initially extruded as oversized blanks having dimensions of 49 inches×61 inches (124.5×154.9 cm). The solidified blanks are then sent through a double sided plane and finished to a thickness of 0.960∀0.010 inch (2.44∀0.025 cm). As a consequence, any deviation in thickness of a panel ultimately made from these planed blanks from the average thickness value of the panel, and thus any surface non-uniformity, is made less than 1.5% in magnitude. The planing process ensures flat and parallel opposing major surfaces are formed on the sheets. Referring to FIG. 3, the peripheral edges 33' of the sheet 33 are trimmed and squared to provide a panel having opposing planar major surfaces 36 and 37 with dimensions of 48∀0.30 inches× 60∀0.30 inches (121.9∀0.76 cm×152.4∀0.76 cm). The sheets are then placed on a CNC router table and the aforementioned edge channel is cut.

As best seen in FIG. 3, the edge channels 30 are cut to a 0.750 (+0.30/−0.000) inch (1.905 +0.76/−0.000 cm) depth "D" into a side edge 33' of panel 33, and with a channel thickness "T" of 0.187 (+0.000/−0.002) inch (0.287+0.000/−0.005 cm). The channel thickness T is centered within ∀0.003 inch (∀0.008 cm) of the centerline "C" of the overall panel thickness To. Thus, the acceptable tolerances of this invention only permit the edge channels made in the panels to be very slightly undersized in thickness as indicated, i.e., 0.187–0.185 inch in size (0.475–0.470 cm), but they cannot be oversized relative to the specified channel depth D. This ensures that the spline, once interfitted, is snugly received and retained. The centerline C of the panel 33 extends parallel to the transverse axis ti of channel 30 shown in FIG. 2.

Referring still to FIG. 3, the spline 3 used in this invention is manufactured from a homogenous plastic formulation. Preferably, the spline is formed as a polyalloy of polyolefin and PVC described in greater detail below. The spline 3 is produced and sized to fit precisely into each edge channel 30 formed in facing side edges of adjoining separate panels. A slight bevel or rounding preferably is formed on the comers of the spline (best seen in FIGS. 1A–B) to facilitate ease of insertion into the channel. The spline dimensions are a 0.187+0.003/−0.000 inch (0.475+0.076/−0.000 cm) thickness $T_s$ in a direction measured parallel to the thickness parameter T of channel 30, and a 1.40 inch (3.56 cm) width $D_s$ in a direction measured parallel to the transverse axes $t_1$ of the panel 33.

The spline 3 preferably is manufactured to a thickness $T_s$ that is 0.001 to 0.003 inch (0.025 to 0.076 mm) thicker than the panel channel thickness T to create a tight fit between the spline 3 and channel 30. The acceptable tolerances of this invention only permit the spline to be very slightly oversized in thickness as indicated, i.e., 0.187–0.190 inch (0.475–0.483 cm) in size, but they cannot be undersized. That is the spline thickness $T_s$ is 0.0 to 2.0%, preferably 0.5 to 2.0%, oversized relative to the thickness T of channel 30. This preferred "negative clearance" provided between the spline and the 0.187 inch (0.475 cm) channel provides an inherent snug fit of the internally beveled channel. Also, the width $D_s$ of the spline 3 is a value that is exactly twice the depth D measurement of channel 30. In this way, the spline 3 tightly fits depthwise into adjoining channels of facing panel edges.

Additionally, and referring to FIG. 3 again, as a consequence of the cutting of the channel 30, stress is relieved from the edge 33' of the panel sheet 33 during the reduction and removal of material. This has been observed to cause a very slight closing of the channel 30 at the edge 33', which, in turn, has been observed to create a grabbing or clamping action on the spline 3, when inserted in the channel 30. This creates a press-fit between the panel sheet 30 and the spline 3. This snug friction joint holds adjoining sheets in place and tightly to one another.

To assemble the panels into an ice skating surface, such as panels 31–34 in FIG. 2, the splines 3 are hammered or otherwise physically forced to laterally engage a first channel in a first panel. A second panel is then slid with hammering or force into place onto the remaining exposed portion of the same spline in which the spline is laterally slid into a second channel on the second panel by application of sufficient physical force to accomplish this result. The panels are put in flush, abutting contacting at their side facing edges once the spline is mutually interfitted in the two panels in this manner. This procedure is repeated for additional sides of the panels to combine additional panels to the original panels, and then the procedure is repeated for the added panels, and so forth, until a skating surface of the desired overall size is assembled. It will be understood that the outermost panels of the assembly will have outer sides that are left unconnected to any other panel. A retainer or channel like member (not shown) can be fitted on the panel sides forming the periphery or perimeter of the rink to alert skaters of the rink edge, and so forth. Otherwise, special clamping means are not necessary for installation at the periphery of the inventive skating rink in order to ensure the stability of the assembly of panels.

The large panel sizes used in the current invention results in a heavier weight for each panel, providing more stability for rink assembly. The weight (about 70–100 lbs. per panel) helps to anchor the panels and keep them shifting, permitting for rough or extremely acrobatic skating. Also, the assembled panels present an uninterrupted surface free from gaps or ridges at the joints of the panels. The assembled structure is very stable in use and the panels do not become misaligned by either forces exterted by a skater or expansion or contraction of the polymeric material. The inventive artificial skating rink assembly is dimensionally stable even though devoid of wood material and, in a preferred embodiment, is assembled from panels that consist essentially of a single homogenous unitary layer connected via the splines. The panels have a uniform cross-section defined between two planar surfaces.

Figure 4A:
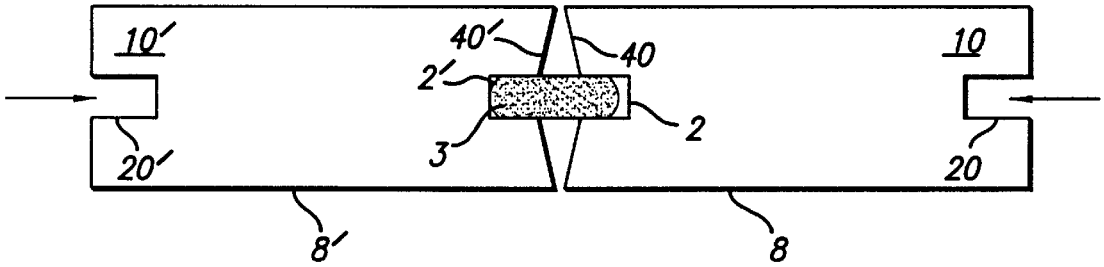
FIG. 4A is a cross-sectional view of a joint section between panels during assembly of an artificial skating rink, taken along section A-A' in FIG. 2, according to a second embodiment of this invention.
Figure 4B:
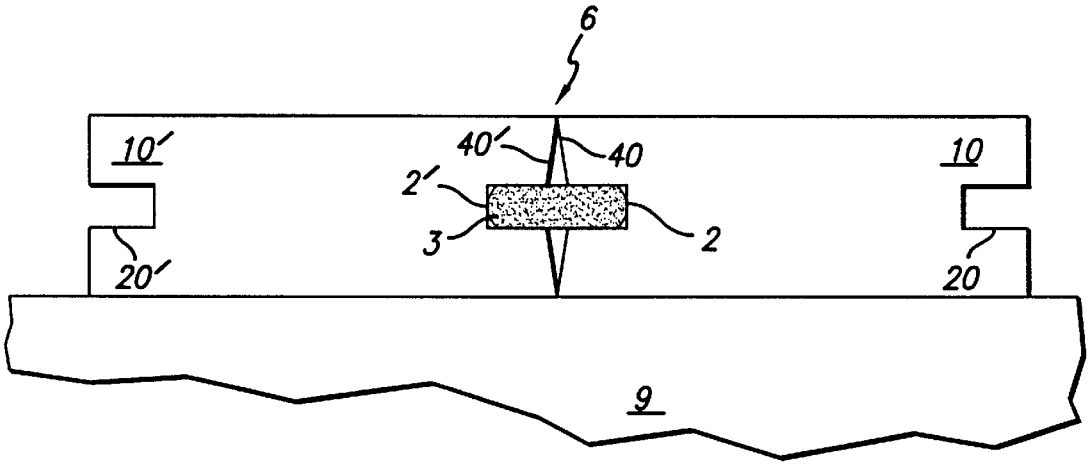
FIG. 4B is a cross-sectional view of a joint section between assembled panels of an artificial skating rink, taken along section A-A' in FIG. 2, according to the second embodiment of this invention; and It will be appreciated that the drawings are not necessarily drawn to scale.

FIGS. 4A and 4B show an alternative embodiment for the manner of machining the sides edges of the panels 10 and 10' in which beveled or chamfered sides edges 40 and 40' are instead machined into the panels. The bevel angle must be selected so as not to overly reduce the effective depths of the channels 2 and 2' such that spline 3 can be embedded deeply enough into each panel to maintain the mechanical connection. This parameter can be determined empirically if necessary.

As can be appreciated from the above, this invention provides means for assembling for assembling a rink from a plurality of portable sections. The assembly is capable of easy installation, using reusable portable elements permitting the rink to be conveniently transported, assembled, and disassembled (if desired). The rink is suitably implemented as either an indoor rink or outdoor/all-season/all-weather artificial skating rink.

Having discussed the construction of the skating rink assembly of the present invention, attention is now directed to the specific preferred types of materials to be used in the above-discussed parts or components used in the skating rink assembly.

The panels described herein are derived from synthetic resin-based formulations that are extruded or molded into the basic desired slab size, which, in turn is machined to introduce the channels in the panel sides. The synthetic resin polymer used as the primary constituent of the panel formulations can be selected from, but is not limited to, one of the following polymers: polyethylene, polypropylene, polycarbonate, polyethylene terephthalate, polydiallyl ester, polytetrafluoroethylene, polymonochlorotrifluoroethylene, copolymers of tetrafluoroethylene and hexafluoropropane, copolymers of tetrafluoroethylene and ethylene, polyvinylidene fluoride, epoxy resins, polyurethane, melamine resins, polyvinyl alcohol, and polyvinyl chloride. Polyolefins, such as polyethylene and polypropylene, are preferred.

More preferably, the polymer is polyethylene, such as a high molecular weight polyethylene (HMWPE) or a high density polyethylene (HDPE). The polyethylene preferably is an ultra-high molecular weight polyethylene having a viscosity-based molecular weight ($M_0$) of from approximately 250,000 to 2,000,000.

A particularly suitable polyethylene is a high molecular weight polyethylene (HMWPE) such as a 5100 series high molecular weight polyethylene available from various suppliers such as General Electric, referred to herein occasionally as "HMWPE 5100". Comparable polyethylenes are also available under the trade names PAXON BA5O-100 from Allied and MARLEX HXM 50100 from Phillips. Other polyethylene resins can be used, such as the DuPont ELTREX B5920 high density polyethylene.

Small amounts of additives and adjuvants are typically included in the plastic formulation used to make the panels. For example, plastic formulations used in making the panels can further comprise a hydrophobic ingredient. This hydrophobic ingredient can be, for example, a fatty acid or fatty acid ester of an alkaline earth metal such as selected from among calcium stearate, calcium palmitate, magnesium stearate, magnesium palmitate, stearic acid, and palmitic acid. Preferably the hydrophobic ingredient is calcium stearate. Such hydrophobic ingredients are multi-functional adjuvants and, for example, they also serve as release agents to facilitate the fabrication of the flat panels by extrusion processing. Also, these hydrophobic ingredients tend to impart a degree of intrinsic lubricity to the surface of the panels. Other alternative hydrophobic ingredients conventional to extruded plastics can also be used.

The panel formulations can further comprise an anti-static ingredient selected, for example, from among glycerol, glyceryl monooleate, glyceryl monostearate, other glycerol esters, ethyl monostearate, and glycerides. Preferably, the anti-static ingredient is glycerol or a glycerol ester. The glycerol and glycerides also function to impart intrinsic lubricity to the panel and its surfaces. ATMER 129 ANTISTAT is a tradename of a useful antistatic agent.

The panel formulations can further comprise at least one ultraviolet stabilizer. The ultraviolet stabilizer can be selected, for example, from among 2-alkyl-(2-hydroxyphenyl)-2H-benzotriazole, benzophenones triazine, phosphonates, resorcinol monobenzoate, bis(2,2,6,6-tetramethyl-4-piperidinyl) sebacate (TINUVIN 770), 2-(2"-hydroxy-3', 5'-di-tert-amylphenyl)benzotriazole (TINUVIN 328), TINUVIN 111FDL, TINUVIN 327, TINUVIN 328, TINUVIN 622 and TINUVIN 783, SIASORB UV531, SIASORB 3346, and UVASORB HA88 (from 3-V Chem). TINUVIN is a trademark of Ciba-Geigy.

The panel formulations can further comprise at least one thermic stabilizer. The thermic stabilizer can be selected, for example, from among WESTON 618-HT (from Borg-Warner), WESTON HPM-12, and TLPE.

The panel formulations can further comprise an anti-oxidant. The anti-oxidant can be selected, for example, from among, butylhydroxytoluene, butylated hydroxyanisole, and octodecyl 3,5-di-tert-butyl-4-hydroxyhydrocinnamate (available as IRGONOX 1076 from Ciba Geigy, IRGANOX B225, and DOVERNOX 76. Preferably, the antioxidant is butylhydroxy-toluene or octodecyl 3,5-di-tert-butyl-4-hydroxyhydrocinnamate.

The panel formulations can further comprise at least one release agent to facilitate the extrusion process and provide a degree of intrinsic lubricity to the surface of the composite structure. This release agent is in addition to the hydrophobic ingredient. The release agent can be selected from the group consisting of CYTEC 3346, CYTEC 6411, and polyethylene glycol 2000.

The composite structure can further comprise, in the polymer layer, titanium dioxide (e.g., RCL-4, RCL-9 and RCL-11) as a coloring agent to give the surface a uniform white appearance.

Other coloring agents and optical brighteners can be used in the polymer layer. Particularly preferred coloring agents include Ultramarine blue 5151, Ultramarine violet 5052, and a blue dye type 82 known as marine blue. A particularly preferred optical brightener is a coumarin derivative known as UVITEX OB (from Ciba-Geigy) or LEUCOPHOR EGM. In addition, various inorganic tinting pigments can be used.

Optionally, other ingredients can be incorporated into the polymer layer of the composite structure. These include compounds that provide fire-resistance and/or self-extinguishing capabilities, such as chloride, or phosphate ions, or triethylenephosphoramide. Alternatively, the polymer layer can contain at least one ingredient that provides anti-rodent, anti-microbial, or anti-parasitic properties to the structure. Such ingredients can include isomers of trichlorobenzene, orthodichlorobenzene, 2-pivaloyl-1,3-indadione, benzophenone, and tin derivatives. Other additives known in the art can also be used.

In one preferred embodiment of the present invention, the panels used in the artificial skating rink of the present invention are formed from a plastic-based formulation including, in weight percentages, 97.00 to 99.50% polyethylene, 0.30 to 0.70% titanium dioxide, 0.09 to 0.50% hydrophobic ingredient, 0.40 to 0.50% ultraviolet stabilizer, 0.09–0.10% antioxidant, and optional minor amounts of coloring ingredients, such as 0.01 to 0.02% total conventional ultramarine coloring ingredients (e.g., ultramarine blue 5151 and/or ultramarine violet 5052). To further enhance the intrinsic lubricity of the surfacing of the finished panel, the panel formulations optionally are formed from a plastic formulation comprising at least 0.19 wt. % total lubricant selected from the group consisting of glycerol, glycerol esters, glycerides, fatty acids, fatty acid esters of alkaline earth metals, and mixtures thereof.

One exemplary panel formulation for the artificial skating rink of the present invention having excellent glide property is listed in Table 1 as follows:

TABLE 1

| Ingredient | Wt. % |
|---|---|
| HMWPE 5100 | 98.430 |
| RCL-4 | 0.650 |
| ATMER 129 ANTISTAT | 0.095 |
| calcium stearate | 0.250 |
| IRGANOX B225 | 0.095 |
| TINUVIN 111FDL | 0.480 |
| Total | 100.000 |

This exemplary formulation is for illustrative purposes only and is not to be construed as limiting the scope of the invention in any manner.

The panels used in the inventive assembly preferably should show no water absorption when tested pursuant to the ASTM-D-570. The above-described panel formulations meet this criterion. Water absorption is undesirable as it can lead to local swells, irregularities or cracks in the surface due to thermal expansions or contractions caused by temperature changes from absorbed water.

The spline preferably is formed from a durable synthetic resin formulation, and, more preferably, from a plastic formulation that is also useful for making the panels, such the panel formulations described above. The spline preferably is formed of a polyolefin, such as described above, as the predominant component (e.g., >90 wt. % of the plastic formulation of the spline) that is lightly modified to include one or more of the above-discussed adiditives in the amounts indicated as well as a minor amount (e.g., 1–10 wt. %) of polyvinyl chloride (PVC) to form a polyalloy (i.e., a polyblend). The spline also could be made from acrylonitrile butadiene-styrene (ABS) copolymer, such as an ABS POLYLAC.

The splines for this invention are preferably used as a homogenous blend of polyolefin and PVC so that they are strong enough to be crack-proof from hammering during installation but not so hard as to dent the polyethylene panels. The splines also were developed for this invention to be flexible enough to give when the panels expand and contract, but rigid enough to insert easily into the channel. The spline and channel together must have the exact fit as described herein for the right tension to prevent buckling or separation of the rink assembly.

To impart the desired shape to the panel or spline plastic formulations, mixtures of the polymer, fillers, additives, adjuvants, and so forth can be prepared in a high capacity double screw extruder. The extruder, die and auxiliaries (e.g., cooling, sizing, post forming, haul-off, milling or cutting) are selected of appropriate dimension and scale to provide panels meeting the specifications as described herein. Screw extruders can be used to process many plastics such as HDPE. For very viscous polymers, such as ultra-high molecular weight polyethylene (UHMWPE), they can be processed by screwless (ram) extrusion. The panels of the present invention preferably are extruded into slabstock sheeting for the subsequent precise planing and machining into finished panels having the channeled peripheral sides formed therein by machining. The panel layer is typically extruded in thicknesses ranging from approximately 0.8 to 1.2 inches (approximately 20.3 to 30.5 mm) as governed in part by the anticipated frequency and severity of use and the desired service life.

Typically, the high molecular weight polyolefin (e.g., polyethylene) slab or sheet is extruded with a smooth finish on top where destined to be the skating surface and a matte finish on the side destined to serve as the bottom surface of the panel that is laid upon a base floor or surface. The bottom surface also can be further roughened, if desired. The matte finish increases the surface area of the sheet and, thus, increases the inter-frictional forces between the bottom surface and the base.

After the panels are assembled into the skating rink assembly, as described above, the upper exposed surfaces of the assembled panels can have applied thereto a friction-reducing ingredient selected, for example, from among silicone resins and silicone oils. Although artificial ice skating rink of this invention can be assembled and operated without a friction reducing ingredient, it is generally preferred to have a friction-reducing ingredient applied to the panels to provide a further margin of safety and comfort.

Preferably, the friction-reducing ingredient is a high-viscosity silicone oil, such as General Electric GE-SF-96-5 silicone oil, Dow Corning 200STC silicone oil , and Rhone Poulenc 47V5 silicone oil. These silicone oils are preferably used at about 5 centistokes.

For skating purposes, the silicone is typically applied only occasionally, e.g., every other day, to help ensure and maintain a consistent glide factor of 90%, as well as preserving the surface. By comparison, wet (natural) ice starts with an initial glide factor of 100%, but the glide factor gradually diminishes to 85% during the second hour of skating. By the third hour of skating, the glide factor has decreased to 78% or less for natural ice. At this point, the natural ice must be resurfaced with a Zamboni machine. As can be appreciated, the artificial ice skating surface of the present invention is much lower in maintenance requirements than natural ice.

Although not preferred nor required, it is possible for the panels to be reinforced and dimensionally stabilized by internally incorporated reinforcements, such as glass fibers, added extrusion or molding of the panels. Also, and although not required, the rink structures of the present invention can optionally be installed over a minimum 6 mm jute or industrial carpet liner and the like to provide a further measure of resiliency to the surface and offer a degree of self-leveling to slightly irregular base surfaces. Foam cushion layers are not required between the underside of the assembled panels and the base support surface.

ADVANTAGES OF THE INVENTION

The present invention provides a low-friction segmented assembly that is suitable as an ice skating surface. Contrary to the conventional thinking and predictions, the all-plastic tongue-and-channel assembly of this invention, which relies only on frictional engagement between flat plastic surfaces flush against each other, does properly and fully hold the panels together during ice skating applications despite the relative smoothness of plastic components, and even though a rougher surface such as wood is not incorporated into the current design. The inventive synthetic ice skating rink is clearly superior to the prior art designs as it avoids buckling problems by virtue of its more facile design involving frictional engagement only of the splines and panels, and without the need for intervening three-dimensional mechanical interlocking pieces.

Additionally, conventional ice skates can be used for skating on the inventive surface. The surface is capable of simulating the gliding properties of natural ice while eliminating the excessive energy requirements associated with the maintenance of natural ice, without the high cost of initial installation, daily maintenance or refrigeration required when natural ice is used as a skating surface.

Also, the assembled structures according to the present invention are easier to skate on than are natural ice because of the consistent 90% glide factor and virtually channelless surface.

Additionally, the surface is characterizable by skaters as "safer than wet ice" because there is no need to refrigerate the surface, thereby resulting in less muscle strain and less fatigue as compared to skating on natural wet ice. Students will be able to learn to skate from instructors more quickly and in less time, due primarily to the fact that teachers can teach for longer intervals and maintain the attention of the students. Conventional steel bladed skates can be used on the inventive artificial ice skating surfaces without the need for modification. There is significantly reduced downtime needed to refinish the skating surface, and maintenance consists only of vacuuming the surface at the end of each day' s skating, washing the surface once or twice each month, and periodic application of the friction-reducing ingredient.

Artificial ice skating rinks according to the present invention are quick and easy to install, requiring no plumbing or refrigeration when used for skating surfaces, and can be used for 12 months of the year. No refrigerant gas, with its increased cost and environmental hazards, is required. Composite structures according to the present invention resist bacterial infection, are nonflammable, and are non-toxic. They can be installed on any solid base surface or flooring, and can be installed in either a portable or permanent manner.

The rink assembly components of this invention can be readily assembled into a stable skating surface without need for extraneous cushion layers, or panel attachment equipment, such as glues, nails, pins, strapping or adhesive taping. Also, the assembly panels used in this invention do not need to be formed with complex mechanical interlock structures at the side edges. Also, the inventive skating surface can be assembled without the need to employ a composite panel having wood, glue or laminations.

The friction-reducing assembled structures of the present invention can be used in other applications than skating rinks where low-friction surfacing is desired with similar advantages.

Although presently preferred embodiments of the present invention have been described in detail hereinabove, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. An artificial ice skating rink consisting of:

a first panel means for providing an ice skating surface, said first panel means having a first elongate channel disposed therein, said channel having longitudinal and transverse axes;

second panel means for providing said skating surface, said second panel means having a second elongate channel disposed therein, said channel having longitudinal and transverse axes; and elongate spline means for slideable insertion into said first channel in a first lateral direction along the transverse axis of said first channel, and for slideable receipt of said second channel when said second panel means is forced in said lateral direction into slideable engagement with said spline, wherein said first and said second panel means are retained exclusively by said spline means against relative motion along said transverse axes.

2. The artificial skating rink of claim 1 wherein the spline means includes a spline having a thickness value that is 0.5 to 2.0% larger than the thickness of each of the first or second channels, and the first and second panels means includes first and second panels, respectively, each having a uniform surface such that any deviations from the average panel thickness are less than 1.5% in value of the average thickness of the respective panel.

3. The artificial skating rink of claim 1 wherein said panel means includes panels formed of a polyolefin.

4. The artificial skating rink of claim 1 wherein said panel means includes panels formed of polyethylene.

5. The artificial skating rink of claim 1 wherein said panel means includes panels formed of polypropylene.

6. The artificial skating rink of claim 1 wherein said spline means includes splines formed of a polyalloy comprised of polyolefin and polyvinyl chloride.

7. The artificial skating rink of claim 1 wherein said panel means includes panels formed of a high molecular weight polyethylene having a viscometric-based molecular weight of approximately 250,000 to 2,000,000.

8. The artificial skating rink of claim 1 wherein said panel means includes panels formed from a plastic formulation including, in weight percentages, 97.00 to 99.50% polyethylene, 0.30 to 0.70% titanium dioxide, 0.09 to 0.50% hydrophobic ingredient, 0.40 to 0.50% ultraviolet stabilizer, and 0.09–0.10% antioxidant.

9. The artificial skating rink of claim 1 wherein said panel means includes panels formed from a plastic formulation comprising at least 0.19 wt. % total lubricant selected from the group consisting of glycerol, glycerol esters, glycerides, fatty acids, fatty acid esters of alkaline earth metals, and mixtures thereof.

10. The artificial skating rink of claim 1 further comprising a friction-reducing ingredient selected from the group consisting of silicone resins and silicone oils, present as a coating applied to upper major surfaces of panels included in said panel means.

11. The artificial skating rink of claim 10 wherein said major surfaces of said panels are rectangular in shape.

12. The artificial skating rink of claim 10 wherein said major surfaces of said panels are square in shape.

13. The artificial skating rink of claim 10 wherein said panels are each comprised of high molecular weight polyolefin, and said major surfaces of said panels are rectangular in shape having dimensions of approximately 48 to 72 inches by approximately 30 to 54 inches and have a thickness defined between the upper and lower major surfaces of approximately 0.8 to 1.2 inches, and said panels have a weight of approximately 70 to 100 pounds.

14. The artificial skating rink of claim 1 wherein said spline means includes a spline having a length shorter than the length of a channel with which it is interfitted.

15. An artificial ice skating rink comprising, in combination:

a flat base surface;

a first panel means for providing an ice skating surface, said first panel means having upper and lower generally planar major surfaces and a first elongate channel disposed therein, said channel having longitudinal and transverse axes;

second panel means for providing said skating surface, said second panel means having upper and lower generally planar major surfaces and a second elongate channel disposed therein, said channel having longitudinal and transverse axes; and elongate spline means for slideable insertion into said first channel in a first lateral direction along the transverse axis of said first channel, and for slideable receipt of said second channel when said second panel means is forced in said lateral direction into slideable engagement with said spline whereby the panels are retained in abutting relationship without additional attachment means and as retained exclusively by said spline means against relative motion along said transverse axes, and wherein said first and said second panel means are positioned adjacent one to another with the lower major surfaces thereof in direct physical contact with said flat base surface.

16. The artificial skating rink of claim 15 wherein said flat base surface is selected from the group consisting of concrete, asphalt, wood and bare ground.

17. An artificial ice skating rink that is devoid of wood, glue and laminations, comprising, in combination:

a flat base surface;

a first panel means including a panel for providing an ice skating surface, said first panel means formed of polyolefin resin and having upper and lower generally planar major surfaces and a first elongate channel disposed therein, said channel having longitudinal and transverse axes;

second panel means including a panel for providing said skating surface, said second panel means formed of polyolefin resin and having upper and lower generally planar major surfaces and a second elongate channel disposed therein, said channel having longitudinal and transverse axes; and elongate spline means including a spline formed of a polyalloy of polyolefin and polyvinyl chloride resin and for slideable insertion into said first channel in a first lateral direction along the transverse axis of said first channel, and for slideable receipt of said second channel when said second panel means is forced in said lateral direction into slideable engagement with said spline, wherein said first and said second panel means are positioned adjacent one to another with the lower major surfaces thereof in direct physical contact with said flat base surface and as retained exclusively by said spline means against relative motion along said transverse axes.

18. The artificial skating rink of claim 17 wherein said flat base surface is selected from the group consisting of concrete, asphalt, wood and bare ground.

19. The artificial skating rink of claim 17 wherein the spline has a thickness value that is 0.5 to 2.0% larger than the thickness of each of the first or second channels, and the first and second panels each has a uniform surface such that any deviations from the average panel thickness are less than 1.5% in value of the average thickness of the respective panel.

20. The artificial skating rink of claim 17 wherein said panels are each comprised of high molecular weight polyolefin, and said major surfaces of said panels are rectangular in shape having dimensions of approximately 48 to 72 inches by approximately 30 to 54 inches and have a thickness defined between the upper and lower major surfaces of approximately 0.8 to 1.2 inches, and said panels have a weight of approximately 70 to 100 pounds.

* * * * *

UNITED STATES PATENT AND TRADEMARK OFFICE
Certificate

Patent No. 6,139,438 Patented: October 31, 2000

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Henry H. Park, West Los Angeles, CA; and Sharon Park, Tarzana, CA.

Signed and Sealed this Twelfth Day of November 2002.

DERRIS H. BANKS
*Supervisory Patent Examiner*
Art Unit 3712